US009366256B2

(12) United States Patent
Testa

(10) Patent No.: US 9,366,256 B2
(45) Date of Patent: Jun. 14, 2016

(54) AUTOMOTIVE VOLUMETRIC VACUUM PUMP

(71) Applicant: PIERBURG PUMP TECHNOLOGY GMBH, Neuss (DE)

(72) Inventor: Alessandro Testa, Viareggio Lucca (IT)

(73) Assignee: PIERBURG PUMP TECHNOLOGY GMBH, Neuss (DE)

( * ) Notice: Subject to any disclaimer, the term of this patent is extended or adjusted under 35 U.S.C. 154(b) by 53 days.

(21) Appl. No.: 14/409,474

(22) PCT Filed: Jun. 18, 2013

(86) PCT No.: PCT/EP2013/062626

§ 371 (c)(1),
(2) Date: Dec. 19, 2014

(87) PCT Pub. No.: WO2013/189931

PCT Pub. Date: Dec. 27, 2013

(65) Prior Publication Data

US 2015/0292505 A1 Oct. 15, 2015

(30) Foreign Application Priority Data

Jun. 20, 2012 (EP) ..... 12172799

(51) Int. Cl.
*F01C 21/04* (2006.01)
*F04C 29/02* (2006.01)
*F04C 27/02* (2006.01)
(Continued)

(52) U.S. Cl.
CPC ..... *F04C 18/32* (2013.01); *F01C 21/08* (2013.01); *F01C 21/0881* (2013.01); *F04C 18/3441* (2013.01); *F04C 25/02* (2013.01);
(Continued)

(58) Field of Classification Search
CPC .... F01C 21/0881; F04C 18/32; F04C 18/344; F04C 29/02; F04C 2270/12
USPC ..... 418/83, 95, 81, 76, 99, 253–255, 183, 418/184, 145, 146
See application file for complete search history.

(56) References Cited

U.S. PATENT DOCUMENTS 3,016,184 A * 1/1962 Hart ..... F04C 18/344 418/101
3,988,080 A * 10/1976 Takada ..... F01C 21/04 418/76
2008/0159896 A1 7/2008 Kishi et al.

FOREIGN PATENT DOCUMENTS

EP 1 850 008 A1 10/2007
GB 1016325 A 1/1966
WO WO 2005/093217 A1 10/2005

*Primary Examiner* — Jesse Bogue
*Assistant Examiner* — Deming Wan
(74) *Attorney, Agent, or Firm* — Norman B. Thot

(57) ABSTRACT

An oil-lubricated automotive volumetric vacuum pump includes a circumferential pump room wall surrounding a pump room. A rotor comprises a rotor body with an oil receiving cavity and a guiding slot. The rotor body is adjacent to the pump room wall. The rotor rotates inside the pump room. A vane with a vane body and a vane end portion shifts in the guiding slot. The rotor body, the vane, and the circumferential pump room wall define at least two pump chambers. An oil discharge channel with a flow opening in a plane is arranged at the vane end portion of the vane and/or at the guiding slot. The flow opening opens so that oil can flow from a pump chamber through the oil discharge channel to the oil receiving cavity only in a retracted position of the vane end portion during a final compression phase of the respective pump chamber.

5 Claims, 4 Drawing Sheets

(51) Int. Cl.

| | |
|---|---|
| ***F04C 2/344*** | (2006.01) |
| ***F04C 18/344*** | (2006.01) |
| ***F04C 18/32*** | (2006.01) |
| ***F01C 21/08*** | (2006.01) |
| ***F04C 25/02*** | (2006.01) |
| ***F04C 29/00*** | (2006.01) |

(52) U.S. Cl.

CPC ..... *F04C29/0035* (2013.01); *F04C 29/02* (2013.01); *F04C 2270/12* (2013.01)

AUTOMOTIVE VOLUMETRIC VACUUM PUMP

CROSS REFERENCE TO PRIOR APPLICATIONS

This application is a U.S. National Phase application under 35 U.S.C. §371 of International Application No. PCT/EP2013/062626, filed on Jun. 18, 2013 and which claims benefit to European Patent Application No. 12172799.4, filed on Jun. 20, 2012. The International Application was published in English on Dec. 27, 2013 as WO 2013/189931 A2 under PCT Article 21(2).

FIELD

The present invention relates to an automotive volumetric vacuum pump which is oil-lubricated and which provides an actuation vacuum of less than 100 mbar. The invention is in particular directed to a vane pump.

BACKGROUND

Automotive vacuum pumps are used to provide a vacuum of an absolute pressure between 100 mbar and 1 mbar as an actuation vacuum for switches, servo brake actuators etc. In contrast to a volumetric vacuum pump without oil-lubrication, an oil-lubricated vacuum pump has reduced frictional losses, reduced wear and, due to a better pneumatic isolation of the rotating pump chambers, an increased pump efficiency.

The discharge of the air and the oil at the end of the discharge phase can, however, be critical if a substantial volume of oil is still present in the rotating pump chamber. If the oil is not completely discharged in the discharge phase and is therefore compressed, a high pressure load at the vane head and an increase of the power consumption can result.

SUMMARY

An aspect of the present invention is to provide an automotive volumetric vacuum pump with oil lubrication with a reduced power consumption.

In an embodiment, the present invention provides an oil-lubricated automotive volumetric vacuum pump for providing an actuation vacuum of less than 100 mbar which includes a circumferential pump room wall arranged to surround a pump room. A rotor comprises a circular rotor body which comprises an oil receiving cavity and a radial guiding slot. The circular rotor body is arranged adjacent to the pump room wall. The rotor is configured to rotate inside the pump room. A vane comprises a longitudinal vane body and a radial vane end portion. The vane is arranged so as to be radially shiftable in the radial guiding slot of the circular rotor body. The circular rotor body, the vane, and the circumferential pump room wall define at least two rotating pump chambers. A radial oil discharge channel is arranged at the radial vane end portion of the vane and/or at the radial guiding slot. The radial oil discharge channel comprises a flow opening in a radial plane. The flow opening is arranged to be open so as to allow an oil to flow from one of the at least two rotating pump chambers through the radial oil discharge channel to the oil receiving cavity only in a retracted position of the radial vane end portion during a final compression phase of the respective one of the at least two rotating pump chambers.

BRIEF DESCRIPTION OF THE DRAWINGS

The present invention is described in greater detail below on the basis of embodiments and of the drawings in which.

DETAILED DESCRIPTION

Figure 1:
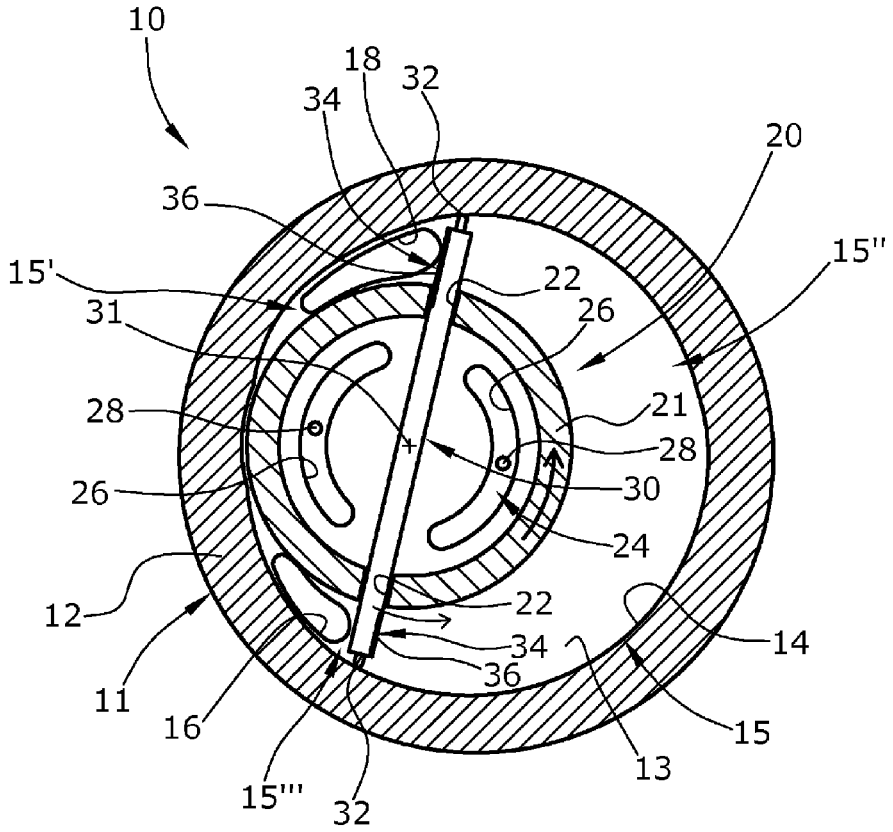
FIG. 1 shows a cross section of an automotive vacuum pump with oil-lubrication.

In an embodiment of the present invention, the vacuum pump is provided with a circular rotor body which is provided with an oil receiving cavity in the middle. The oil collected in the receiving cavity can be discharged from the receiving cavity. The rotor body rotates inside a pump room which is surrounded and defined by a circumferential pump room wall. The rotor body is arranged adjacent to one sector of the pump room wall. This arrangement is typical for a vane pump.

The pump is provided with at least one vane with a longitudinal vane body which is arranged radially shiftable in a radial guiding slot of the rotor body. The rotor body, the vane, and the circumferential pump room wall define at least two, and typically three, rotating pump chambers. The typical arrangement of the vacuum pump is a single-vane pump where the vane is provided with two vane heads so as to define, together with the pump rotor being arranged adjacent to the circumferential pump room wall, three rotating pump chambers. The vane head can be an integral part together with the vane body or can be a separate part made of the same or another material as the vane body.

In an embodiment of the present invention, a radial oil discharge channel is provided at a radial end portion of the vane, i.e., at the vane head, or is provided at the guiding slot. The oil discharge channel is not necessarily exactly radial, but is provided with a radial component so that oil can flow radially inwardly through the discharge channel. The oil discharge channel is provided with a flow opening in a radial plane, whereby the flow opening is arranged so that the oil can flow from the pump chamber through the discharge channel to the oil cavity only in the retracted position of the vane end portion and during the final compression phase of the respective rotating pump chamber. When the end portion of the vane is moving into its retracted position, the rotating pump chamber at the bow side of the vane is in the final compression phase so that the pneumatic outlet opening of the pump room is very small or can even be already completely closed. In this final compression phase, the flow opening lying in a radial plane is open so that the oil remaining in the pump chamber can be discharged into the oil receiving cavity until the final compression phase is completely finished and the chamber volume of the respective rotating pump chamber is zero.

The radial oil discharge channel being open in the final compression phase provides that no substantial overload pressure can occur so that the vane is not stressed and bent in a tangential direction, and no unnecessary power consumption occurs.

In an embodiment of the present invention, the flow opening can, for example, be arranged so that the flow opening is covered, and thereby closed by the vane body or by the rotor body in a non-retracted position of the vane end portion. If the discharge channel is provided in the vane end portion, the flow opening is covered by a surface defining the guiding slot of the rotor body in the non-retracted position of the vane end portion. If the discharge channel is provided in the rotor body and is arranged close or directly adjacent to the guiding slot of the rotor body, the flow opening is then covered by the vane body in the non-retracted position of the vane end portion. By closing the flow opening in the non-retracted position of the vane end portion, it is provided that the air of the respective pump chamber is completely discharged through the pneumatic outlet opening, and not through the discharge channel.

In an embodiment of the present invention, the discharge channel can, for example, be provided as a radial groove in the rotor body, whereby the groove is covered by the vane body. The radial groove can, for example, have a groove opening in a radial plane, whereby the groove opening is covered by the vane body to define a closed discharge channel. The radial groove in the rotor body is a simple construction and allows for a relatively easy manufacturing.

The discharge channel can alternatively or additionally be provided as a radial groove in the vane body, whereby the groove opening is covered by a surface of the guiding slot of the rotor body. The radial groove in the vane body is also a simple construction and also allows for a relatively easy manufacturing.

The discharge channel can alternatively or additionally be provided as a radial conduit in the vane body and/or in the rotor body. The radial conduit defines a closed discharge channel which is provided with a flow opening at the inlet or at the outlet of the radial conduit.

Three embodiments of the present invention are described below with reference to the drawings.

FIG. 1 shows an automotive volumetric vacuum pump 10 which is provided as a so-called single vane pump. The vacuum pump 10 is oil-lubricated to improve the pneumatic effectively of the vacuum pump 10. The vacuum pump 10 is able to provide a total pressure of less than 10 mbar for providing an actuation vacuum for automotive actuators driving flaps, switches, servo brakes etc. The vacuum pump 10 can be driven mechanically by an internal combustion engine, or can be directly driven by its own electric motor.

The vacuum pump 10 is provided with a pump housing 11 including a circumferential pump room wall 12 enclosing and defining a pump room 15. The inner surface 14 of the pump room wall 12 is not necessarily circular. Inside of the pump room 15 a rotor 20 is provided which is defined by a circular rotor body 21 and a vane 30. The rotor body 21 is provided as a rotor body ring and is arranged directly adjacent to one section of the pump room wall 12. An oil receiving cavity 24 is defined inside the rotor body 21. The rotor body 21 is provided with two radial guiding slots 22 in which a longitudinal vane body 31 of the vane 30 is inserted. The vane body 31 is supported radially shiftable in the guiding slots 22 between two guiding slot surfaces lying in a radial plane. The vane body 31 has two axial vane end portions 33 which are both provided with a separate vane head 32 which is supported radially shiftable at the vane body 31.

The rotor body 21, the vane body 31, and the pump room wall 12 define three rotating pump chambers 15', 15", 15'".

A pneumatic inlet opening 16 and a separate pneumatic outlet opening 18 of the pump room 15 are provided in a side wall 13 of the pump housing 11. When the rotor 20 rotates, which is, in the shown embodiment, in counter-clockwise direction, one rotating pump chamber 15'" is in a suction phase, the following rotating pump chamber 15" is in a transition phase, and the third rotating pump chamber 15' is in a compression phase.

In the oil receiving cavity 24, a circular rotor basis plate can be provided with two circular discharge openings 26 corresponding to two discharge openings 28 at the side wall 13 of the pump housing.

Figure 2:
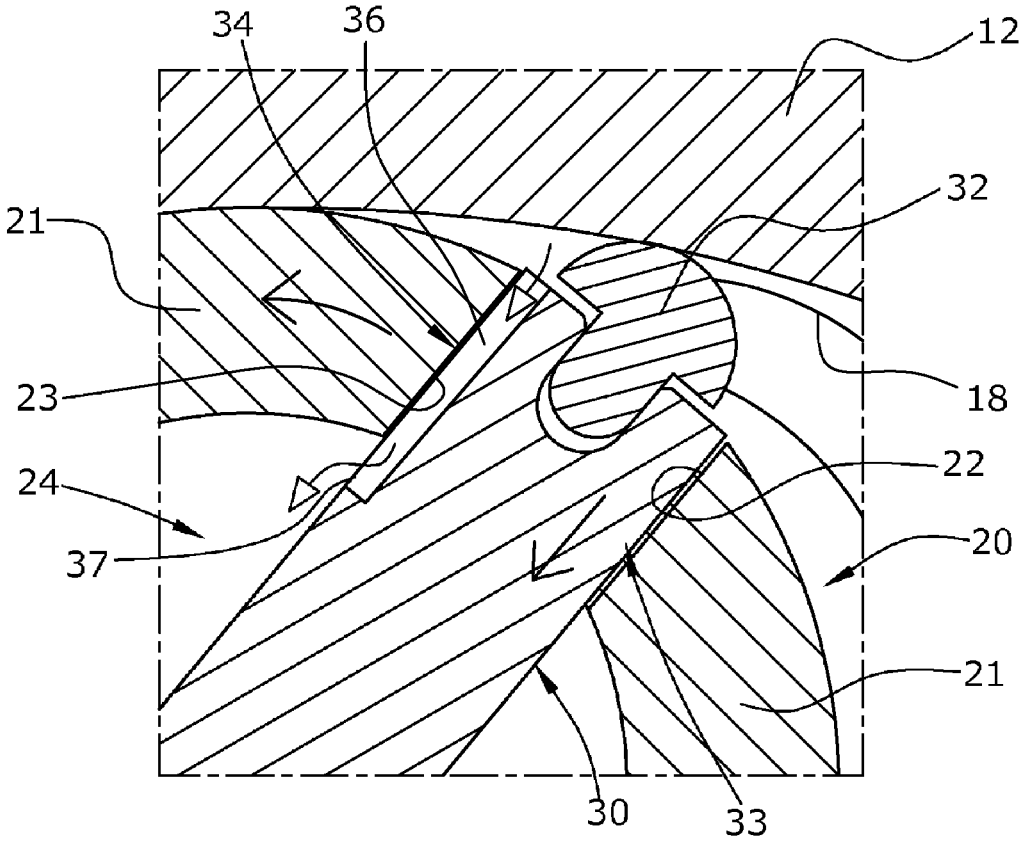
FIG. 2 shows a first embodiment of an oil discharge arrangement of the vacuum pump of FIG. 1.

Referring to the embodiments shown in FIGS. 1 and 2, both vane end portions 33 are provided with an oil discharge channel 34 which is provided as a radial channel groove 36 with a groove opening orientated in a circumferential direction and lying in a radial plane. As is shown in FIG. 2, the vane end portion 33 is in a retracted position in the final compression phase of the respective rotating pump chamber 15'. In this vane position, the groove opening of the channel groove 36 is substantially, but not totally, covered by a side wall surface 23 of the guiding slot 22, whereby the side wall surface 23 is lying in a radial plane. A proximal section of the groove opening is not covered by the guiding wall surface 23, but is open to the oil receiving cavity 24. This section of the groove opening defines a flow opening 37 which allows the oil in the rotating pump chamber 15' in the final compression phase to radially flow into the oil discharge channel 34 and from the oil discharge channel 34 through the flow opening 37 into the oil receiving cavity 24.

In a less-retracted position of the vane end portion 33 of the vane 30, the flow opening 37 is completely covered by the side wall 23 of the guiding slot 22 so that no fluid can be discharged from the respective rotating pump chamber 15'. When the respective vane end portion 33 projects with the complete oil discharge channel 34 out of the rotor 20, no fluid at all can flow from the respective rotating pump chamber 15' to the oil receiving cavity 24.

Figure 4:
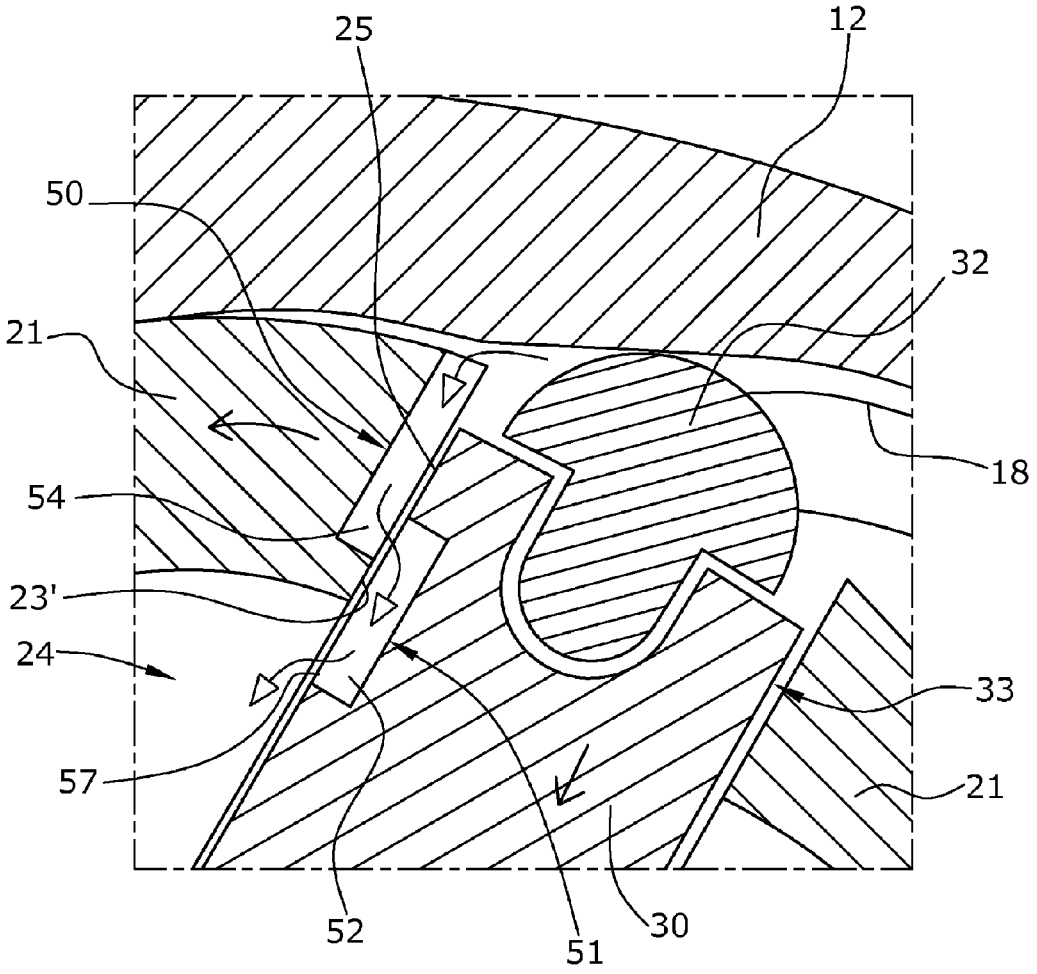
FIG. 4 shows a third embodiment of an oil discharge arrangement of the vacuum pump of FIG. 1.

The embodiment shown in FIG. 4 provides two groove-like discharge channels 50, 51 at the guiding slot 22 as well as at the vane 30. The guiding slot discharge channel 50 is provided as a radial groove 54 in the side wall surface 23' of the guiding slot 22, and the vane discharge channel 51 is provided as a radial groove 52 in the vane end portion 33, whereby the groove opening is, in part, covered by a side wall 25 of the vane end portion 33. The radial length of both vane channels 50, 51 is less than the radial thickness of the circular rotor body 21. The flow opening 57 is defined by the proximal section of the groove opening of the vane discharge channel 51.

Figure 3:
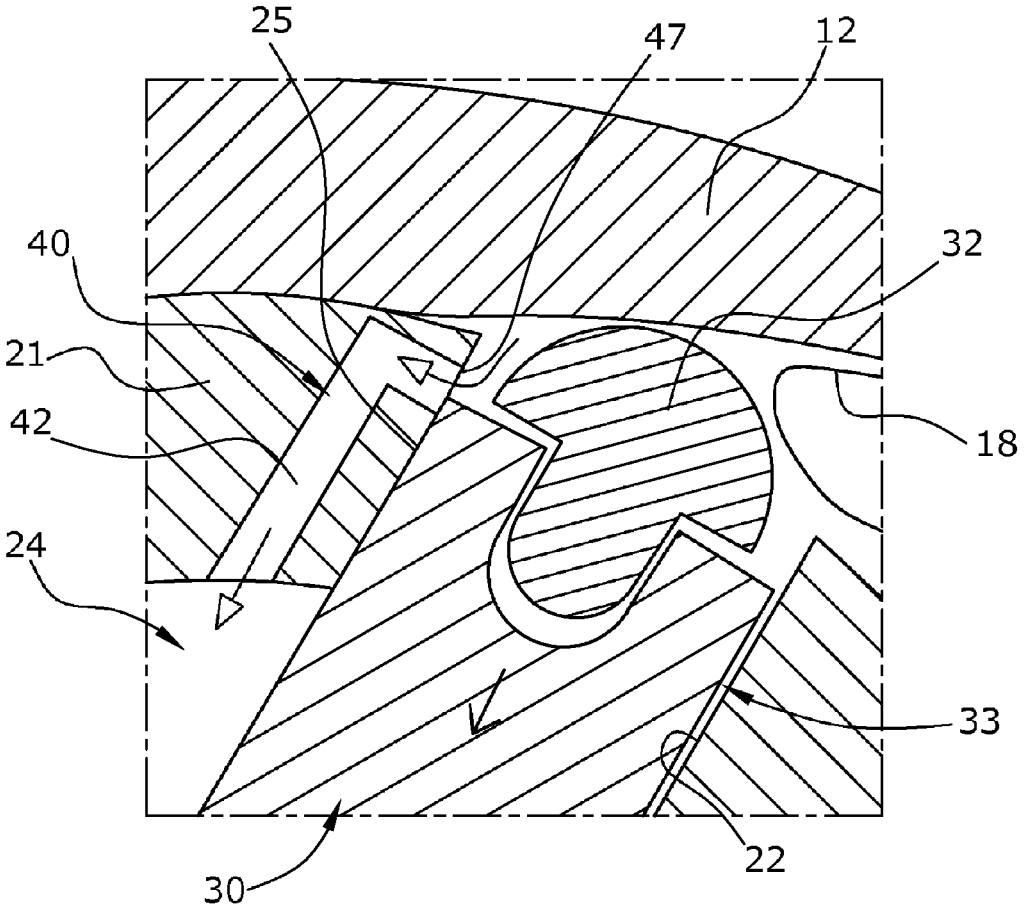
FIG. 3 shows a second embodiment of an oil discharge arrangement of the vacuum pump of FIG. 1.

The embodiment of FIG. 3 shows the discharge channel 40 defined as a conduit 42 in the circular rotor body 21. The flow opening 47 is defined by an inlet opening of the conduit 42, whereby the flow opening 47 lies in a radial plane and is not covered by a side wall 25 of the vane end portion 33 in the retracted position of the vane end portion 33.

The present invention is not limited to embodiments described herein; reference should be had to the appended claims.

What is claimed is:

1. An oil-lubricated automotive volumetric vacuum pump for providing an actuation vacuum of less than 100 mbar, the oil-lubricated automotive volumetric vacuum pump comprising:

a circumferential pump room wall arranged to surround a pump room;

a rotor comprising a circular rotor body which comprises an oil receiving cavity and a radial guiding slot, the circular rotor body being arranged adjacent to the pump room wall, the rotor being configured to rotate inside the pump room;

a vane comprising a longitudinal vane body and a radial vane end portion, the vane being arranged so as to be radially shiftable in the radial guiding slot of the circular rotor body, the circular rotor body, the vane, and the circumferential pump room wall defining at least two rotating pump chambers, a radial oil discharge channel arranged at least one of the radial vane end portion of the vane and at the radial guiding slot of the circular rotor body, the radial oil discharge channel comprising a flow opening in a radial plane, the flow opening being arranged to be open so as to allow an oil to flow from one of the at least two rotating pump chambers through the radial oil discharge channel to the oil receiving cavity only in a retracted position of the radial vane end portion during a final compression phase of the respective one of the at least two rotating pump chambers.

2. The oil-lubricated automotive volumetric vacuum pump as recited in claim 1, wherein the flow opening is arranged to be covered and closed by the longitudinal vane body or by the circular rotor body in a non-retracted position of the radial vane end portion.

3. The oil-lubricated automotive volumetric vacuum pump as recited in claim 1, wherein the radial oil discharge channel is provided as a radial groove in the circular rotor body, and the radial groove is covered by the longitudinal vane body.

4. The automotive volumetric vacuum pump as recited in claim 1, wherein the radial oil discharge channel is provided as a radial groove comprising a groove opening in the longitudinal vane body, the groove opening being covered by a surface of the radial guiding slot.

5. The automotive volumetric vacuum pump as recited in claim 1, wherein the radial oil discharge channel is provided as a radial conduit in at least one of the longitudinal vane body and in the circular rotor body.

* * * * *